US005260101A

United States Patent [19]

Larson et al.

[11] Patent Number: 5,260,101

[45] Date of Patent: Nov. 9, 1993

[54] MULTICOMPONENT SYSTEM FOR A REFINISH COATING COMPOSITION AND A METHOD FOR APPLYING THE SAME

[75] Inventors: John C. Larson, Clarkston, Mich.; Stacey A. Wittmeyer, Riverton, N.J.

[73] Assignee: E. I. Du Pont de Nemours and Company, Wilmington, Del.

[21] Appl. No.: 820,932

[22] Filed: Jan. 15, 1992

[51] Int. Cl.[5] ..... B05D 1/02; B05D 7/14

[52] U.S. Cl. ..... 427/388.2; 427/426

[58] Field of Search ..... 427/426, 388.2

[56] References Cited

U.S. PATENT DOCUMENTS

| | | | |
|---|---|---|---|
| 2,679,208 | 5/1954 | Euverard | 103/49 |
| 4,382,114 | 5/1983 | Höhlein | 427/407.1 |
| 4,522,879 | 6/1985 | Krueger | 428/323 |
| 4,745,011 | 5/1988 | Fukuta et al. | 427/426 |
| 4,809,909 | 3/1989 | Kukesh | 427/426 |
| 5,059,655 | 10/1991 | Martz et al. | 525/131 |
| 5,076,495 | 12/1991 | Dykmans | 427/426 |
| 5,154,950 | 10/1992 | Rosthauser et al. | 427/426 |

FOREIGN PATENT DOCUMENTS

| | | |
|---|---|---|
| 0078172 | 5/1983 | European Pat. Off. . |
| 0219131 | 4/1987 | European Pat. Off. . |

*Primary Examiner*—Terry J. Owens
*Assistant Examiner*—Erma Cameron
*Attorney, Agent, or Firm*—Chris P. Konkol

[57] ABSTRACT

A multipackage system for providing a refinish coating composition and a method for applying the same onto a substrate. The method comprises separately transporting at least one component under pressure to a proportioning device which provides a controlled volumetric ratio of the components. The components of the coating composition are then mixed and coated onto the substrate at ambient temperature or, to accelerate curing, at moderate temperatures. The compositions involve new or modified existing chemistries that have a more limited pot life than conventionally formulated for commercial use.

5 Claims, 3 Drawing Sheets

MULTICOMPONENT SYSTEM FOR A REFINISH COATING COMPOSITION AND A METHOD FOR APPLYING THE SAME

BACKGROUND OF THE INVENTION

This invention relates to a system of components for providing a coating composition and also a method for applying such a composition to refinish a substrate. In particular, the present method involves metering and proportioning a controlled ratio of the components of the system, prior to mixing. The proportioned components are then sprayed immediately onto the substrate. This invention is especially useful in the automotive refinish industry for such coatings as clearcoats, basecoats, and primers.

There presently exists a variety of systems for proportioning components and delivering them to atomizers or dispensing equipment in proper ratios. For example, such systems are disclosed in U.S. Pat. Nos. 4,966,306; 4,953,754; 4,529,000; 3,776,252; 3,672,389; and 3,530,873. Devices for proportioning coating compositions are marketed and have been widely used in original equipment manufacturing (OEM) of automobiles and other industrial equipment. However, such devices are not generally used in automotive refinish or body shops, where only one vehicle at a time is normally painted or finished.

The term "automotive refinish" refers to the application of a finish to an automobile subsequent to the original manufacturing process. In the OEM factory, the metal body of an automobile is typically coated or painted in an assembly line process, permitting the use of coating compositions on a large scale which are cured at elevated temperatures, typically as high as 150°-160° C. However, once the car has been fitted with plastic bumpers, rubber tires, and the like, it is no longer feasible to cure finishes at high temperatures. In the automotive refinish context, coatings normally are cured at ambient temperatures, although cure time may be accelerated by heating to temperatures up to 80° C.

In refinish applications, the coating material being applied to a substrate as a finish is typically the product of a multipackage system that has been mixed manually prior to use. In a typical two component system, the first package is composed primarily of an acrylic polymer containing crosslinking monomer units. The second package is composed of a crosslinking agent required to react with the polymer in the first package. The proper volumetric mix ratio of the components is determined by the proper stoichiometric ratios of the reactive parts of the components needed for the crosslinking reaction to take place. Either package may also contain catalysts for promoting and initiating the crosslinking reactions, as well as additives, reducers, and pot life extenders. In some cases, more than two packages or components may be involved, for example a catalyst may be present in a third component.

Conventional refinish methods, for applying a coating composition to a substrate, have been limited in several significant respects. Typically, the components of the coating composition are mixed manually. Once mixed, the composition must be used within a certain time frame. The potlife is defined as the time during which the mixture is suitable for spraying. More specifically, it is the point at which the applicator can perceive a discernable difference in the ease of handling due to an increase in the viscosity of the mixed components. This time frame is to some extent subjective and can vary, depending on the particular chemical reaction involved, from an increase of several seconds to tens of seconds according to a common paint industry measurement referred to as the Zahn #2 measurement of viscosity. This measurement involves the placing of the composition in a Zahn cup, which is a fixed volume cup with a specific orifice size. The amount of time is takes for a particular mixture to flow through the orifice is indicative of the viscosity of the mixture. This pot life characterization is to some extent subjective and dependent on the chemistry and applicator. However, pot life, for the present purposes, can be generally defined as a doubling of the viscosity in centipoise. For conventional applications, the paint or finish material must have a pot life of at least about 2-3 hours in order to give the user ample time to effect the refinishing task. Such a constraint limits the formulating latitude of the coating formulator. In particular, new high solids and/or low VOC (i.e., low content of volatile organic compounds) compositions have been difficult to develop because of problems of short the pot life with such compositions. Such high solids compositions for coatings tend to exhibit a shorter pot life and rapid increases in viscosity, due to the higher concentration of reactants. This can present problems in applying them to substrates. On the other hand, if stabilizers or extenders are added to the formulation of the finish composition to increase the pot life, then the film drying and curing time is extended. This will increase the length of time needed to complete a job, thereby decreasing the productivity of the refinishing task. In addition, when the finish of an automobile is still wet, it is more susceptible to the introduction of defects, for example, caused by either accidental rubbing or air-bore contamination such as dust and dirt.

In view of the above, there is a need for an improved method of applying a refinish coating composition to an automobile or the like. It would be particularly desirable to solve the problems or difficulties associated with the formulation and spraying of high solids, low VOC coating compositions.

BRIEF DESCRIPTION OF THE DRAWINGS

The present invention will be more fully understood from the detailed description below when read in connection with the accompanying drawings wherein like reference numerals refer to like elements and wherein.

BRIEF DESCRIPTION OF THE INVENTION

Figure 1:
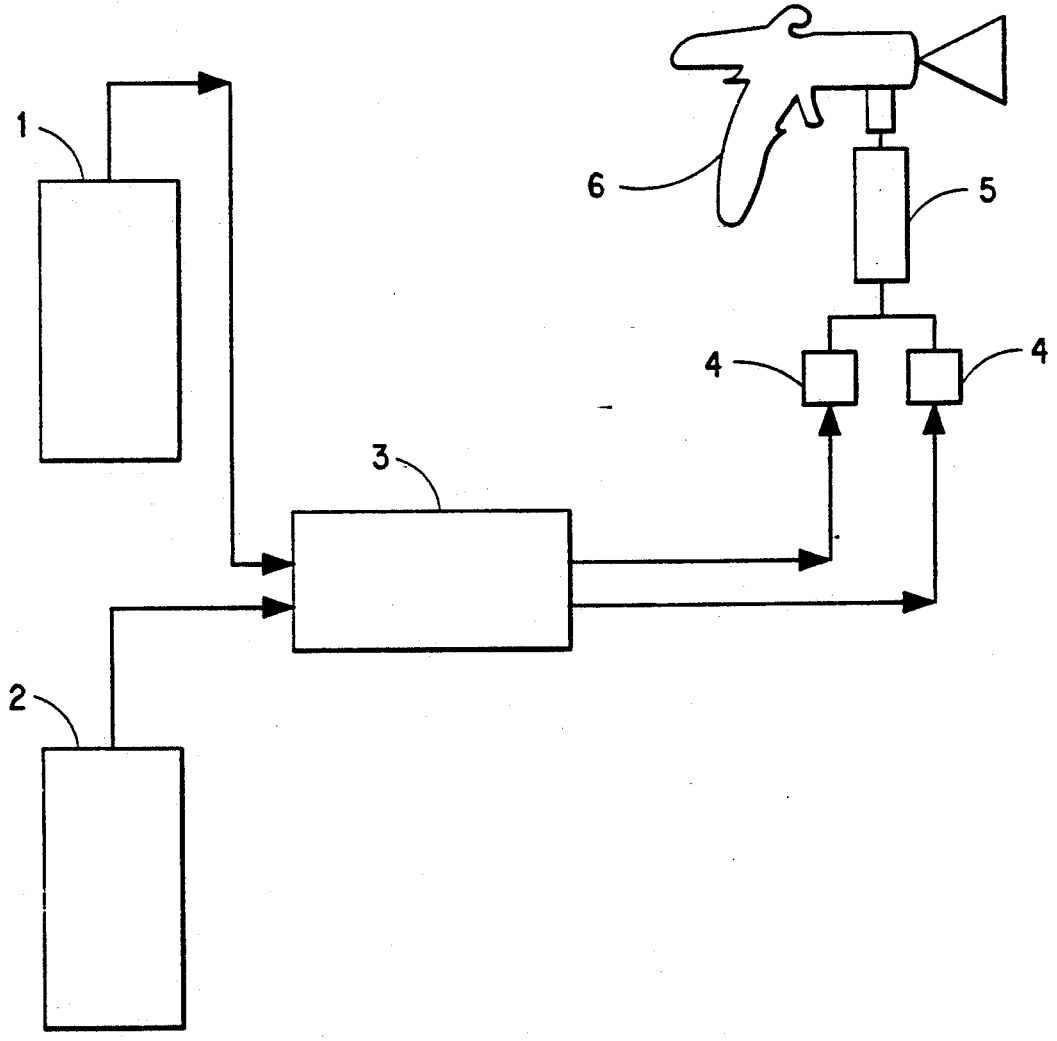
FIG. 1 is a diagram of a system for applying a coating composition, which system comprises a means for supplying, proportioning, mixing and spraying the composition according to the present method.

The present invention, in one aspect, is directed to an improved method of applying a coating composition to a substrate that dries and cures at temperatures ranging from about ambient to 80° C., but preferably at ambient. The coating composition comprises a plurality of components. For example, in a two package system, each of two components are proportioned and mixed, and the combined composition, after application to the substrate, undergoes a crosslinking polymerization reaction, dries and cures. The method comprises the following steps:

(a) supplying each of a plurality of separate components, which form the final coating composition, at least one component of which is supplied under pressure;

(b) transporting each component in a stream through a conduit leading from said container to a common proportioning device, powered by said pressure, to provide a controlled volumetric ratio of the components in accordance with the stoichiometric ratio for the chemistry of the composition;

(c) homogenously mixing the components of the coating composition; and (d) spraying or coating the mixed composition onto the surface of a substrate;

wherein the coating composition per se is characterized by a viscosity that doubles in centipoise, at a temperature of 25° C., within a time period of less than 45 minutes from the time of mixing.

The present method has several advantages for use in the automotive refinishing industry. In general, the invention provides a method for applying a multicomponent crosslinking coating composition of any given VOC where the system is highly reactive or the functionality and/or catalyst level can be increased to speed film property development without regard to pot life. This is possible because the components are not mixed until they reach the gun or close vicinity thereof.

The present method can be used to apply faster drying and curing finishes or paints which will increase productivity in the finishing process. In addition, the present method might improve the occupational health of workers in the field, since it would not be necessary to manually mix multicomponent compositions containing toxic materials, which reduces potential exposure of workers to the toxic materials.

In another aspect of the present invention, a multipackage refinish coating system consisting of a plurality of separately contained liquid components is disclosed. This system, upon mixing, provides a coating composition that has a pot life characterized by a doubling of viscosity in centipoise, at a temperature of 25° C., within a time period less than 45 minutes, more preferably between 2 seconds and 45 minutes, and more specifically between 10 seconds and 30 minutes.

DETAILED DESCRIPTION OF THE INVENTION

As indicated above, the present invention is directed to an improved component system for a coating composition and a method for applying a multicomponent refinish coating composition, which composition may be used to refinish automobiles or other substrates. The components are formulated such that, when mixed, they provide a coating composition for coating or spraying, which composition per se is characterized by a coating composition that has a pot life characterized by a viscosity, at a temperature of 25° C., that doubles in centipoise within a time period less than 45 minutes, preferably between 2 seconds and 45 minutes, and more narrowly between 10 seconds and 30 minutes, and most specifically between 10 minutes to 30 minutes, although this preference may vary depending on the particular composition and application. By the terminology "composition per se is characterized" is meant that the composition is tested for viscosity to determine its properties or pot life apart from the present method, since when the composition is employed during the present method, the composition, of course, would never be allowed to reach its pot life as defined herein, since it is desired to spray it on the substrate before then.

Viscosity may be measured in various ways. A common industry measurement in the paint industry is with a orifice viscometer such as the Zahn #2 cup, which is a simple device having a known volume and orifice (e.g., 0.11 inch diameter). The cup is filled with a sample of the paint and the time required for the liquid to flow is measured. A Zahn #2 cup is commercially available from Pacific Scientific, Gardner/Neotec Instrument Division. Since Zahn #2 viscosity is measured in seconds, it must be converted to centipoise (one centipoise equals $1\times10^{-3}$Pa·sec) using a standard formula. It is noted that the Zahn #2 cup would not be a good method of characterizing a composition having a very short pot life (less than about 5 minutes), because of the change in viscosity is faster than the time required for measurement. Another method of measuring viscosity, requiring more expensive and complicated equipment, but generally considered more accurate than an orifice device is by means of a rotational viscometer such as a Brookfield SYNCHRO-LECTRIC (commercially available from Brookfield Engraving Co., Stoughton, Mass.). See *Kirk-Othmer Encyclopedia of Chemical Technology*, Vol. 16., beginning at p. 259 (3rd edition John Wiley & Sons) for a more detailed description of rheological measurements.

The present invention involves a means for applying the coating composition within the limited pot life of the coating composition. One such means of application involves an inexpensive, simple proportioning device which may be used to supply the liquid components of the coating in the proper mix ratio to an atomizer or spray device. As indicated above, several significant benefits of the present invention may be realized. The invention can reduce the risk of human exposure to harmful or toxic volatiles by not requiring manual measuring and mixing of the components of the coating composition prior to spraying. This also reduces labor, as well as eliminating waste generation from cleaning the measuring and mixing equipment. Another advantage is that higher solids, lower VOC, quicker drying compositions may be more easily used. Such compositions are better for the environment. However, the invention is not necessarily limited to the use of high solids, low VOC paints, and other compositions may be used, nor is the present invention limited to the illustrated application equipment, as other means are commercially available.

With reference to the drawings, FIG. 1 shows one embodiment of a system for practicing the invention, including containers of coating materials, a volumetric proportioner, a static mixer, and a spray gun. A volumetric proportioner 3 is shown connected, at one end, to separate supplies of the components of the coating composition. A component A in supply container 1 and a component B in supply container 2 are both connected to the volumetric proportioner 3 which provides a controlled ratio of the two components to a static mixer 5. A check valve 4 in each line prevents backflow of the mixed composition. The mixed composition enters a coating device, in this case a spray gun 6, for spraying the paint onto a substrate such as an automobile surface being refinished. Although, in the embodiment shown, the mixer 5 is a separate device located between the volumetric proportioner 3 and the spray gun 6, an alternative arrangement is to have the mixer as an integral part of the spray gun 6. In fact, it is possible for the volumetric proportioner, mixer, and spray means to be integrated into a single compact unit.

The coating material to be sprayed may be supplied in a standard container or a container customized for use in the present invention. In the case of standard containers, they may be opened (the top lid removed) and placed in a larger capacity enclosure, such as a pressure pot, under pressure. Alternatively, only one of the components need be supplied under pressure to operate the volumetric proportioner. It can provide the pumping action for the other components. A suitable pressure is 20 to 80 psig, which is readily obtained from a standard source of compressed air, commonly available in a refinish or body shop. Alternatively, a conventional pump may be employed to provide a component under pressure to the proportioner. The volumetric proportioner will operate at much higher fluid pressures. With properly designed systems, the proportioner could be used to feed air assisted airless spray systems (400 or more psig) or airless spray systems (2000–3000 psig).

In one simple embodiment for a two package system, the two containers of the two package system are opened, vented to the atmosphere, and placed in a pressure pot under the necessary pressure. Each of two conduits or hoses are placed within the fluid contents of each of the two containers and connected to the volumetric proportioner as described in more detail below.

A customized container for supplying the component compositions may be used. Such a container may suitably be made of metal, such as aluminum or steel, or composite plastic. Such a customized container, however, must be capable of withstanding the pressures employed in the present method and remaining air tight. The container may be non-returnable or returnable. In one embodiment, the container has an inlet means for allowing the introduction of compressed air or other gas under pressure and an outlet means for allowing the coating material to be delivered for use. The outlet means of the container may include a dip tube extending toward the bottom of the container and couplings or fittings for connection to conduits or hoses as needed. The inlet means of the container may have a one way valve for use in pressurizing the container. The inlet and outlet means may be incorporated into a removable lid of a container if desired. It will be apparent to the skilled artisan that when only one of the containers is being pressurized and used to actuate the volumetric proportioner, then the other containers should be vented.

Figure 2:
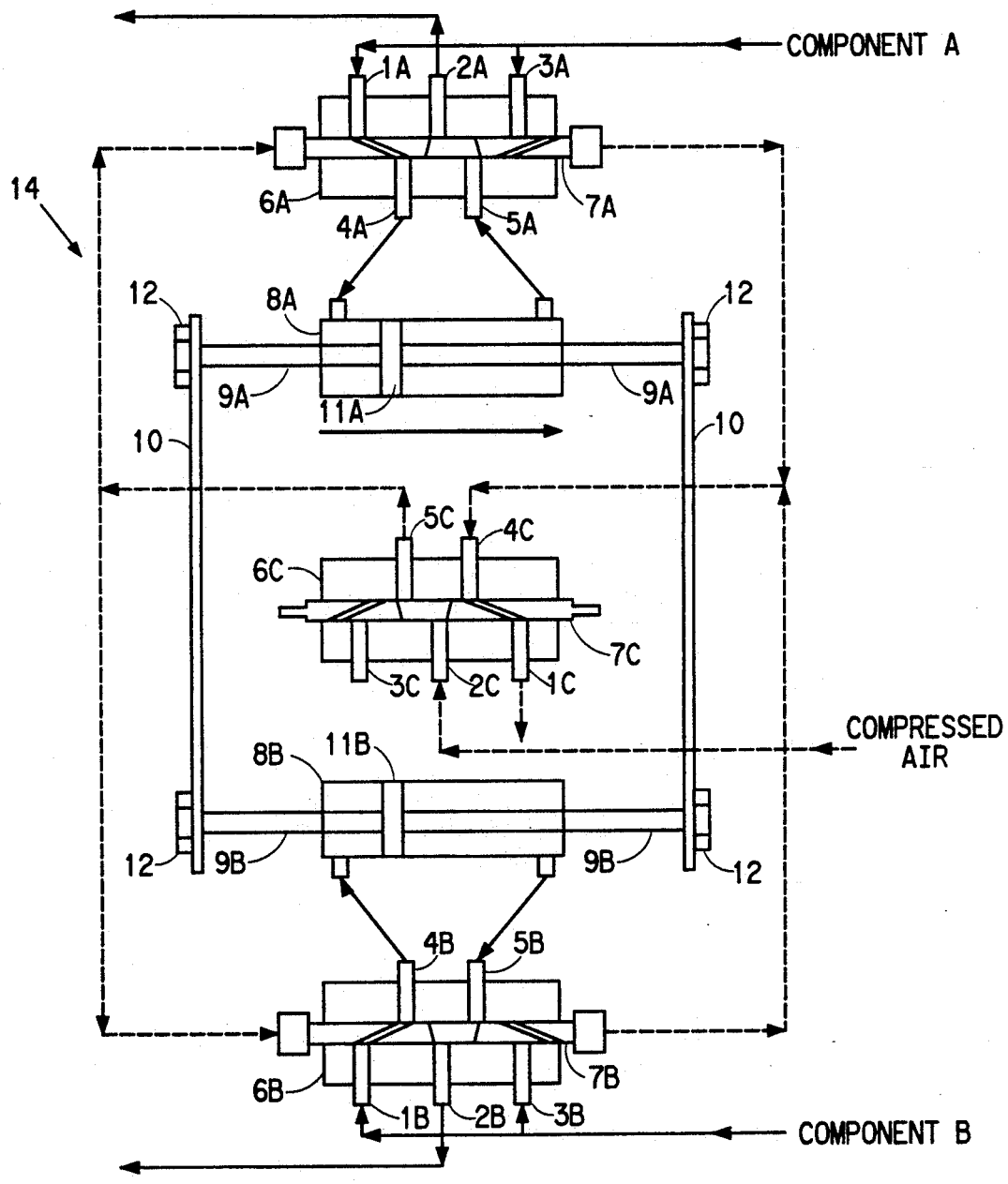
FIG. 2 is a top cross-sectional view of one embodiment of a proportioning device employed in the present invention.

Turning now to FIG. 2, we see a diagram of one embodiment of a proportioning device 14, hereafter referred to as a kinetic proportioner as it uses only the kinetic energy of the one component under pressure to drive itself, for use with a two package system made up of components A and B. The skilled artisan will readily appreciate that the design of this embodiment can be analogously modified for a three or more package system.

The kinetic proportioner comprises two double acting cylinders 8A and 8B with cylinder rods 9A and 9B that are attached to pistons 11A and 11B. The cylinder rods extend out of the cylinders to common brackets 10. The rods for the cylinder 8A and 8B are fixed to the common brackets 10 with nuts 12. The common brackets force the pistons 11A and 11B to move simultaneously. There are fluid control valves 6A and 6B for each of the components being proportioned (component A and component B in FIG. 2). There is also an air control valve 6C that provides pilot control air to the fluid control valve spools 7A and 7B. The fluid control valve spools are designed such that fluid can be directed alternately in and out of ports 4A and 5A, as well as 4B and 5B, as the spool is positioned (by pilot air) alternatively to the right and left.

In normal operation for a two component proportioner, fluid components A and B come to the kinetic proportioner under pressure from a supply source. In the following description, each number referred to in FIG. 2 may be followed by A or B, depending on which fluid component A or B is involved. Each fluid is directed to ports 1 and 3 (1A and 3A or 1B and 3B) of its respective control valve. When spools 7A and 7B are in their right position, as shown in FIG. 2, the fluid components A and B enter into the control valves through ports 1A and 1B, respectively. The spools 7A and 7B direct the fluid component out of the ports 4A and 4B. The fluids then enter into the left end of their respective cylinders 8A and 8B. Pistons 11A and 11B are forced to move to the right (both cylinders simultaneously). As the pistons move, fluid on the right side of the piston is displaced out through the the right end of the cylinders 8A and 8B. Fluid A (from cylinder 8A) and fluid B (from cylinder 8B) enter their respective fluid control valves (6A and 6B) through ports 5A and 5B. The spools 7A and 7B direct the fluids out ports 2A and 2B to the mixer and spray device.

As shown in FIG. 2, the compressed air enters the control or pilot valve 6C through conduits or passageways 2C and 5C, to enter the left side of the component fluid valve spools 7A and 7B and exits through conduits 4C and 1C. However, when pistons 11A and 11B reach the end of their movement to the left, common bracket 10 physically strikes spool 7C in the air control valve 6C. This redirects the pilot air signal through conduits 2C and 4C to the right side of the fluid control valve spools 7A and 7B, moving the spools to their left position, and the air now exits through conduits 5C and 3C. In this position, the fluids A and B enter the control valves through ports 3A and 3B, and the fluid flows are reversed. Fluids A and B flow out ports 5A and 5B to the right end of cylinders 8A and 8B, moving pistons 11A and 11B to the lift. This displaces fluids A and B on the left side of the pistons, and into ports 4A and 4B on the control valves 6A and 6B, where the fluids are directed out ports 2A and 2B by the spools 7A and 7B.

This cycle is repeated continuously to give a steady flow of fluid A out port 2A and fluid B out port 2B. The volumetric flow ratio of the two fluids is dependent on the ratio of the volumetric displacement of the fluids as each piston travels its entire stroke length. Because the piston movement of the two cylinders is fixed together, their stroke length is equal; and because each cylinder's displacement is a constant, this results in controlled volumetric ratio between the fluids.

The proportioned fluids A and B are directed to a spray device through hoses or tubings. Just prior to the spray device or as an integral part of the spray device, the components are mixed, for example, using a static in-line mixer. Check valves are used for each fluid just prior to the static mixer to prevent back flow of one fluid into the hose or tube of the other.

The embodiment as shown in FIG. 2 could be modified to eliminate the pilot air control valve. Fluid control valves 6A and 6B could be located between the cylinders (8A and 8B) similar to how air control valve 6C is oriented. In this modification, fluid control valves 6A and 6B would be actuated by bracket 10 physically striking and moving spools 7A and 7B. This would eliminate the need for air control valve and the pilot air signal tubes. As a result, the device would operate without any other source of energy other than the fluid pressure of one or more of the components.

Figure 3:
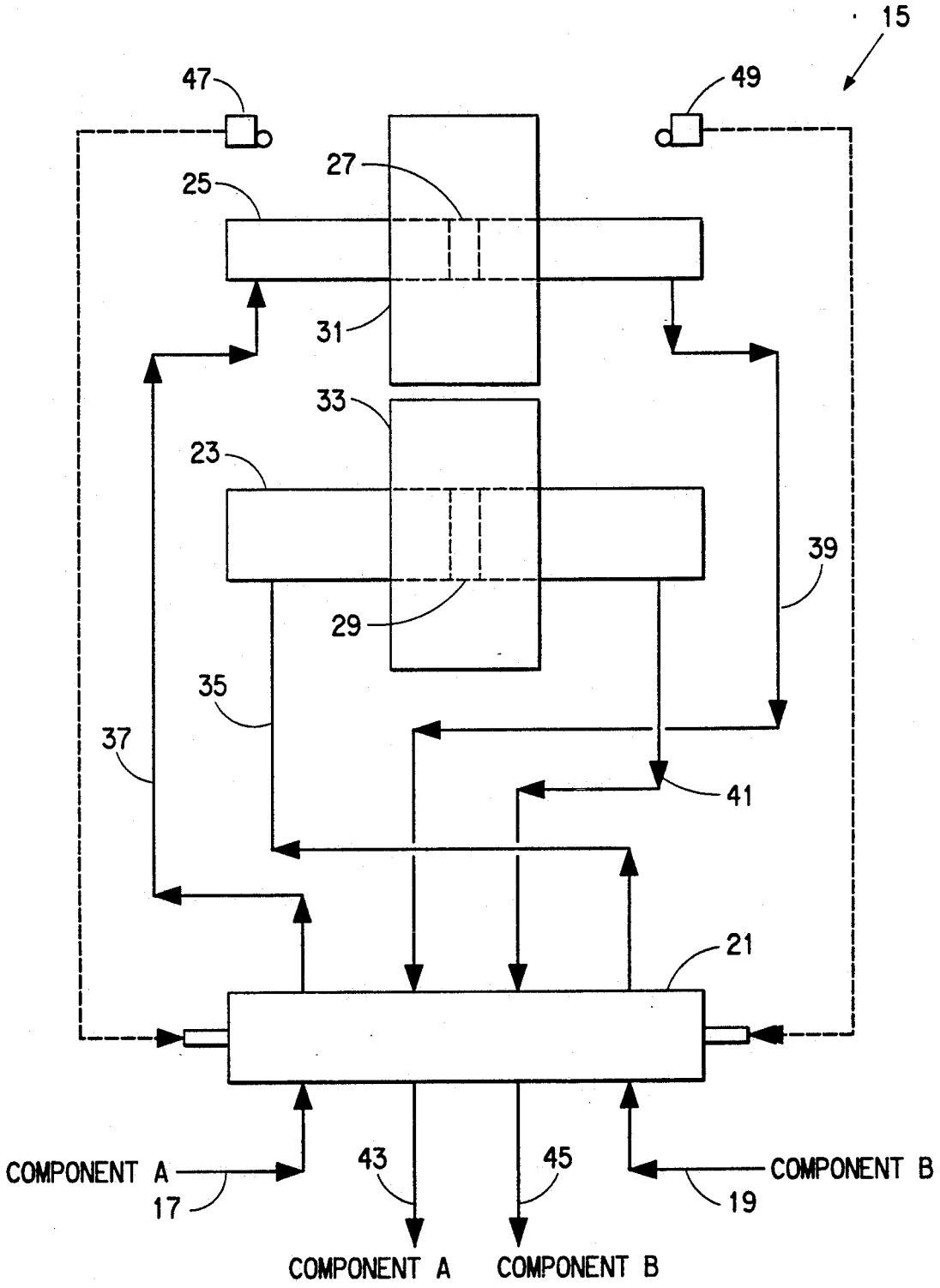
FIG. 3 is a top cross-sectional view of a second embodiment of a proportioning device employed in the present invention.

A diagram of a second embodiment of a means that may be employed to practice the present invention is shown in FIG. 3. Two conduits 17 and 19 serve to transport and supply component A and component B, respectively, to the kinetic proportioner generally shown as 15. The conduits 17 and 19 lead to a fluid control valve 21 (which may the same as shown in FIG. 2) for directing each of component A and component B to cylinder 23 and cylinder 25, respectively. These cylinders each have a piston 27 and 29, respectively, fittingly adapted for movement as described below. In the embodiment shown in FIG. 3, piston followers 31 and 33 corresponding to each piston are connected magnetically to the pistons and are physically connected to each other in order to assure synchronous movement of the two pistons. It will be understood by the skilled artisan that other arrangements are possible. For example, although separate cylinders and pistons are shown in FIG. 3, various other configurations may be employed. For example, in U.S. Pat. No. 4,966,306, an arrangement is shown in which a first cylinder and piston is concentric to another cylinder and piston. In an alternate embodiment, two pistons and cylinders may be in series with the piston shafts connected.

In operation, the control valve 21 is designed such that when in a first position, the components A and B can flow into the two cylinders though a first set of passageways 35 and 37, respectively, while the components A and B are displaced out the two cylinders through a second set of passageways 39 and 41 to conduits 43 and 44, respectively. When the pistons 27 and 29 reach the end of their strokes, the control valve 21 is energized to change position and, in a second position, to provide connection of the inlet conduits 17 and 19 with the second set of passageways 39 and 41, while the components A and B are forced out of the cylinders through the first set of passageways 35 and 37 into outlet conduits 43 and 45, respectively. These components in conduits 43 and 45 are then transported to a mixer and spray device, as indicated above.

With a two package system consisting of component A and B, for example, the kinetic proportioner operates on the principle of simultaneous displacement of fluids from two double acting cylinders. The cylinders in FIG. 3 are operated with their pistons locked together, by means of the piston followers, so they synchronously utilize the same stroke length. The piston followers are connected to the pistons by way of magnetic coupling. The volumetric displacement of each cylinder is proportional to the square of its inside diameter. In the embodiment of FIG. 3, by varying the diameter of one or more of the cylinders, one can change the proportioning ratio and thus change the stoichiometic ratio of the components involved in the crosslinking reaction. In the embodiment of FIG. 2, changing the diameter(s) of the cylinders as well as the cylinder rods will also vary the proportioning ratio. At least one of the two components, as indicated above, are fed to the proportioning device under pressure. Preferably, this fluid pressure drives the two cylinders with no other energy source required, except for the case when compressed air is used to pilot the control valve. Although less preferable, the control valve may be operated with electrical solenoid valves. Conventional electronic circuitry may be used to operate the control valve. Such a circuit is disclosed in U.S. Pat. No. 4,966,306.

In FIG. 3, as the fluid components move the pistons in the cylinders toward the opposite end of the cylinders, stroke limit switches 47 and 49 sense the position of the followers just before the piston reaches the end of the cylinder. The limit switch sends a pilot signal to the control valve, and moves a spool in the control valve. When this happens, the direction of the liquids in the cylinders is reversed, and the pistons are forced toward the other ends of the cylinders.

As the pistons move, they displace the liquids from the cylinders simultaneously. The displaced liquids are pushed through the control valve and to the static mixer and the spray gun. In the case of a rodless cylinder, the liquids are displaced in a volume ratio equal to the ratio of the squared diameters of the cylinders. The piston followers trigger a limit switch and the process is repeated continuously. The speed of movement of the pistons is proportional to the fluid pressure applied. Of course, the fluid flow is increased as the fluid pressure and piston speed is increased. The fluid stream from the spray gun is extremely steady with no noticeable pulsing. Pulsation dampening is not necessary.

The proportioning device shown in FIG. 3, in contrast to existing equipment used in other applications, does not require any motors or, in its preferred embodiment, any source of power other than the pressure on one or more of the liquid fluids being applied to move the pistons. As indicated above, the pressure of the incoming liquid fluid, on one side of the piston, causes the piston to move in a first direction, which piston in turn causes a corresponding amount of the same liquid fluid, present on the opposite side of the piston, to be displaced and expelled out the other end of the cylinder. Exiting the cylinder, the liquid fluid is transported via a second passageway and, through the control valve, into an outlet conduit leading towards the spray device.

The kinetic proportioner shown herein, according to best mode requirements, is self-driven in that internal electric motors or pumps are not needed to accomplish the proportioning. In fact, liquid fluid power, in the absence of any electrical energy, can be used to accomplish the proportioning. As a consequence, the present proportioner can be smaller, less complicated, and lower in cost than alternate equipment on the market, which might also be used to apply a refinish composition according to the present invention.

The kinetic proportioner can be used to feed any type of coating application device that requires a pressurized supply of the coating composition, as will be readily appreciated by the skilled artisan.

In the embodiments shown, the volumetric displacement of each piston movement determines the ratio of components. It is possible for the cylinders and/or the piston rods to be replaceable in order to provide various volumetric ratios.

The kinetic proportioner is preferably readily disassembled for easy cleaning.

For homogenously blending and mixing the components of the composition prior to coating, a static mixer is preferable. Such a static mixer is either in communication with, or integral with the spray gun or other coating device. Static mixers, for example with helical baffles within the housing, cause mixing of a plurality of components by creating turbulent flow. The volume of mixed components can be minimized by the close coupling of the mixing device to the spraying device or other means for coating. Alternatively, the components of a composition can be separately sprayed in proximity such that homogenous mixing of the droplets occur in the air, and/or on the substrate. Such an embodiment may involve dual nozzled spray guns or mixing the components during atomization.

The present method may be used to apply coating compositions such as primers, basecoats, topcoats, or clearcoats. However, the present method is especially convenient for applying clearcoats and primers, since they are normally one color and therefore do not require color changes between applications, and it is therefore not necessary to use solvents to purge the equipment between use. However, it may be just as convenient to apply pigmented coatings when refinishing a substantial number, or fleet, of cars or trucks of the same color.

As indicated above, the present invention allows (but does not require) the formulator greater latitude in modifying existing chemistries without being limited to the pot life requirements of existing methods in automotive refinish. Such modifications include, but are not limited to, higher functionality resins, more concentrated or different catalysts, lower VOC, and/or a mix of crosslinkers with different catalyst requirements.

Depending on the needs and the particular application and circumstances, compositions which involve existing chemistries may be modified to provide faster dry/cure time at lower VOC, lower spray viscosity at lower VOC, and/or lower cost.

The present invention also allows greater latitude in developing compositions based on new chemistries, for example, compositions having higher reactivities, which compositions have not been previously thought feasible for use with existing methods in automotive refinishing because of pot life requirements.

Depending on the application and particular circumstances or needs, the benefits of compositions involving new chemistries may include improved film properties (for example, resistance to chemicals, UV light, or mechanical damage), durability, lower cost, improved appearance at lower VOC, and/or better atomization at lower VOC.

The above mentioned compositions, either involving modified or new chemistry, may have various VOC levels in response to various dry time and cure time needs, for example for spot repair versus overall repair. Both kinds of compositions may be formulated to lower the risk of user exposure to hazardous/toxic materials, to improve productivity (less labor is involved to measure and mix the components), and/or to reduce waste (less activated material left over and less solvent needed for clean up).

The refinish coating composition for use in the present method may include, but is not limited to, compositions comprising the following combination of functional groups: amine/isocyanate, amine/epoxy/isocyanate, hydroxy/isocyanate, amine/epoxy, epoxy/anhydride, hydroxy/isocyanate/amine, anhydride/hydroxy, or amine/anhydride. The catalyzed reaction of such combinations of functional groups can result in crosslinking polymerization reactions that cause curing of the coating composition. Such compositions range from commercially known systems to systems such as the amine/isocyanate, anhydride/hydroxy, and amine/anhydride that have been hitherto been considered too fast for practical or commercial use.

As an example of one type of coating composition usable in the present invention is a two package isocyanate system. Such systems have been difficult to formulate because of pot life concerns. Conventionally, a conflict occurs between the need to accelerate cure and the need to retard viscosity increasing in the application equipment. Two package isocyanate systems, for use in refinish applications, contain isocyanate groups which, depending on the particular composition, may react with alcohols, amines, amides, or phenols. Both aromatic and aliphatic di- or polyisocyanates are available, for example, toluene diisocyanate (TDI), diphenyl methane diisocyanate (MDI), hexamethylene diisocyanate (HMDI), and isophorone diisocyante, and the like. Owing to the toxicity of low molecular weight or volatile isocyanates, polyfunctional isocyanate adducts, which may be derived from diisocyanates, are preferable. Conventional two package finishes based on hydroxy functional resins and isocyanate adducts have found wide application with curing at atmospheric temperatures or moderate curing conditions. Suitable resins include polyester, polyether, epoxy, acrylic, and alkyd resins. Two package hydroxy functional acrylic resins, also referred to as acrylic urethanes, are frequently used in refinishing. Such compositions exhibit a good combination of durability, gloss retention, hardness, flexibility, and high gloss. By using relatively low molecular weight acrylic resin, the solids content can be high. Although the crosslinking reaction with polyisocyanate takes place across a range of temperatures, even below 5° C., the application of heat will generally accelerate through-drying. For optimum bodyshop throughput, acrylic urethanes are typically cured for 30–40 minutes at 80°–100° C., leading to a metal temperature of about 60° C. maximum.

EXAMPLE 1

This example illustrates components of a coating composition and the application thereof according to the present invention. The use of various polyisocyanate activators in formulations A, B, and C were examined to assess their ultimate contributions to film property development. In this particular experimental series, the effects of Tolonate HDT, Cythane and combinations of both activators were examined.

In each case, a low $T_g$ (23° C.), branched side chain acrylic polyol with a hydroxyethylmethacrylic (HEMA) monomer content of 23.5% by weight was reacted with the polyisocyanate. Dibutyl tin dilaurate was used as a catalyst to speed the reaction. As a result, the coating hardens within a shorter time; however, the pot life of the mixture is significantly reduced.

The polyisocyanate activator TOLONATE DHT (trimer of hexamethylene diisocyanate) has excellent durability performance and a fast cure rate, which is controlled by catalyst and polyol optimization. Normally, the amount of dibutyl tin dilaurate (hereafter DBTDL) catalyst is 0.01% by weight of binder. In order to achieve a faster dry time and increased early hardness properties, a higher $T_g$ activator such as an adduct of tetramethyl xylidine diisocyante with trimethylol propane such as "Cythane 3160" activator (from Ciba-Geigy) can be used as a crosslinker. Drawbacks of using this polyisocyanate are slow cure rate and the need to use higher quantities of DBTDL catalyst in the presence of primary hydroxyl groups to achieve room temperature cure, about ten times the amount needed for TOLONATE DHT. However, this increased catalyst level results in a reduction in pot life such that conventional methods of application are not feasible. Therefore, the following formulations were applied according to the present method to obtain a mixture of components having the desired balance of early cure/early hadness properties. The formulations had a VOC of 3.65 lbs/gal and an Equivalent Ratio (NCO/OH) equal to 1.00. The following ingredients were used, in parts by weight:

TABLE 1

| | A | B | C |
|---|---|---|---|
| Part 1 - Polyol Component | | | |
| Acrylic polyol | 221.29 | 179.27 | 201.24 |
| "Tinuvin 1130" UV absorber (from Ciba-Geigy) | 6.68 | 6.71 | 6.20 |
| "CGL 123 Hals" (Cibya Geigy) | 4.46 | 3.60 | 4.04 |
| 10% Dibutyl tin diluarate solution | 5.57 | 11.18 | 11.17 |
| Acetic acid, glacial | 0.89 | 0.72 | 0.81 |
| Part 2 - Isocyanate Component | | | |
| Tolanate DHT activator | 60.41 | 0.00 | 22.89 |
| Cythane 3160 activator | 0.00 | 112.42 | 63.10 |
| Part 3 - Reducer | | | |
| PM Acetate | 64.68 | 69.41 | 60.52 |
| Xylene | 6.10 | 4.94 | 5.55 |
| "Exxate 600" solvent (from Exxon) | 10.55 | 8.55 | 9.60 |

Theoretical constants for the above compositions were as follows:

Solids=55.8%
VOC=3.65 lbs/gal
Equivalent ratio (isocyanate/hydroxyl)=1.00
% catalyst (on solids)=0.2500% (A), 0.5000% (B&C)
% (UVA (on solids)=3.00%
% HALS (on solids)=2.00%

The determined properties were as follows:

TABLE 2

| | A | B | C |
|---|---|---|---|
| Viscosity (Zahn #2) in seconds | 30.85 | 31.06 | 33.24 |
| Viscosity after 15 minutes | 42.3 | 37.3 | gel |
| Viscosity after ½ hour | 54.1 | 39.0 | gel |
| Viscosity after 1 hour | gel | 41.0 | — |
| Hardness after 1 Day (Persoz) | 52 | 106 | 71 |
| Hardness after 3 Days | 67 | 171 | 95 |
| Hardness after 7 Days | 82 | 207 | 121 |
| Swelling ratios 1 Day | 1.66 | 1.92 | 1.69 |
| (smaller ratio, better cure) 7 Days | 1.61 | 1.81 | 1.67 |

The results indicate that the use of TOLONATE DHT activator as an activator leads to early cure properties. The activator "Cythane" gives the best early hardness development. A mixture of both, to obtain formulation C according to the present invention, gives a good balance of both properties, which is an advantage over the exclusive use of either activator. However, in the case of formulation C, the increased catalyst level led to a substantial reduction in potlife. This formulation cannot be sprayed using conventional equipment because of the rapid viscosity increase and subsequent gelation of the mixture. This formulation could be sprayed, however, according to the present method.

While the preferred embodiments of this invention have been described above in detail, it is to be understood that variations and modifications can be made therein without departing form the spirit and scope of the present invention as set forth in the appended claims.

What is claimed is:

1. A method for applying a multicomponent refinish coating composition onto the surface of an automotive substrate and curing the composition at a maximum temperature of 100° C., the method comprising:

(a) supplying, in separate containers, a plurality of components, where at least one of the components while in said separate containers is under compressed air at a pressure of 20 to 80 psig;

(b) introducing the components into a volumetric proportioner, powered by the pressurization of the component or components by said compressed air, so that the volumetric proportioner provides a controlled ratio of the components according to the stoichiometric needs of the chemistry involved;

(c) homogenously mixing the components after exiting the proportioner to provide a refinish coating composition; and (d) coating the refinish coating composition onto the surface of an automotive substrate in order to refinish the same, where the coating is dried and cured;

wherein the refinish coating composition per se is characterized by a viscosity at 25° C. that doubles in centipoise in a time period between 10 seconds and 45 minutes from the point of mixing.

2. The method of claim 1, wherein the coating composition has a viscosity that doubles in centipoise within a time period between 10 seconds and 30 minutes from the point of mixing.

3. The method of claim 1, wherein the curing occurs at a temperature from ambient to 100° C.

4. The method of claim 1, wherein the coating composition comprises an acrylic polyol and an isocyanate crosslinking agent.

5. The method of claim 1, wherein the coating composition is a clearcoat or primer.

* * * * *